US006976786B1

(12) United States Patent
Stanley, Jr.

(10) Patent No.: US 6,976,786 B1
(45) **Date of Patent: *Dec. 20, 2005**

(54) COMBINATION WARNING FLAG AND STORAGE BAG

(76) Inventor: Murray E. Stanley, Jr., 12464 Oakfort Pl., San Diego, CA (US) 92131

( * ) Notice: Subject to any disclaimer, the term of this patent is extended or adjusted under 35 U.S.C. 154(b) by 0 days.

This patent is subject to a terminal disclaimer.

(21) Appl. No.: 08/292,286

(22) Filed: Aug. 18, 1994

(51) Int. Cl.[7] ..... B65D 33/06
(52) U.S. Cl. ..... 383/25; 383/9; 383/22; 383/66; 383/117
(58) Field of Search ..... 208/803, 573; 383/66, 9, 22, 25, 117; 116/28 R

(56) References Cited

U.S. PATENT DOCUMENTS 1,693,266 A * 11/1928 Baldwin ..... 383/117
2,040,559 A * 5/1936 Luttrell ..... 383/9
2,602,482 A * 7/1952 Lyon ..... 383/117
2,656,869 A * 10/1953 Timmons ..... 116/28 R
3,241,857 A * 3/1966 Goetz ..... 280/851
3,425,539 A * 2/1969 Mach ..... 206/803
3,678,886 A * 7/1972 Tibbet ..... 116/173
3,791,337 A * 2/1974 Schamblin ..... 116/28 R
4,095,360 A * 6/1978 Dinan et al. ..... 40/603
4,125,212 A * 11/1978 Courchesne ..... 383/66
4,207,983 A * 6/1980 Wolske ..... 383/117
4,228,834 A * 10/1980 Desnick ..... 383/13
4,580,667 A * 4/1986 Herwood ..... 190/110
4,801,081 A * 1/1989 O'Connor ..... 232/1 C
4,960,399 A * 10/1990 Lyon ..... 383/117
5,065,864 A * 11/1991 Schmitt ..... 206/278
5,092,682 A * 3/1992 Fenick ..... 383/22
5,118,019 A * 6/1992 Harrison ..... 224/563
5,156,274 A * 10/1992 Williams et al. ..... 206/573
5,741,076 A * 4/1998 Cammack ..... 383/9
5,830,119 A * 11/1998 Chen ..... 493/210
6,371,642 B1 * 4/2002 Nelson et al. ..... 383/23

* cited by examiner

*Primary Examiner*—Jes F. Pascua
(74) *Attorney, Agent, or Firm*—Charmasson, Buchaca & Leach, LLP

(57) ABSTRACT

A bag for storing small objects such as stretch cords, tie downs, bungee cords and the like, that are used in personal, occupational, recreational and marine pursuits. The bag may be made in an appropriate size and color so that it is capable of being used as a warning flag for attachment to objects to call attention to them, such as on a long load or the like. A rigid header bar is attached to the storage bag along an upper edge thereof to maintain the shape of the bag, especially when it is used as a flag. A handle is attached to the rigid header bar to carry the combined flag and bag, and hook-receiving openings are formed in the header bar for attachment of a handle or tie-down straps to secure the combined flag and bag to an object.

8 Claims, 2 Drawing Sheets

COMBINATION WARNING FLAG AND STORAGE BAG

FIELD OF THE INVENTION

This invention relates generally to storage bags for storing small items. More particularly, in one form the invention relates to storage bags which are particularly suited for marine use. The bag may also be used as a warning flag for long loads.

BACKGROUND OF THE INVENTION

For the storage of small items, such as tie-down straps, especially on vehicles such as trucks, boats, recreational vehicles, and the like, there is very little available that is convenient to use and which is durable and economical.

Persons desiring to store small items, particularly in a vehicle, generally place the items in an out-of-the-way space, such as behind the seat, or in a small compartment, or in a make-shift bag. This method is not convenient, and the items frequently become lost or tangled with other small items. One item that is frequently carried, especially on a boat, or by tradesmen, or in a recreational vehicle, is one or more tie down straps for securing objects. A variety of tie downs are known in the art, including tie down straps, and stretch cords or bungee cords.

For marine use, in particular, there is no suitable bag that is economical, easy to use, and resistant to the effects of water and ultraviolet radiation.

Further, in the transportation of some materials, such as construction materials and the like, for example, it is sometimes necessary to carry loads that are longer than the vehicle used for carrying them. These long loads accordingly protrude beyond the end of the transporting vehicle. In this event, it is generally required to tie or otherwise suitably secure a warning flag on the end of the protruding material. A warning flag may also be required in other instances to call attention to a dangerous condition, or simply to call attention to some object or feature.

In the prior art, warning flags of various sizes and shapes are typically used for this purpose. These flags usually comprise a rectangular piece of brightly colored material, having one or more tie straps at one side for securing the flag to an object. In many instances, the warning flag is simply stapled or nailed to the object.

As currently practiced in the art, tradesmen, for example, frequently carry a supply of warning flags and tie down straps or bungee cords for use in handling materials, as discussed above. This requires storage of both the flags and the tie downs. A plurality of bungee cords, in particular, may be carried for use in a variety of ways, including use as tie downs to secure objects. These cords generally become tangled, and are easily misplaced or lost, resulting in not having the necessary tie down when needed. In addition, the flags may also become misplaced or lost, or may be used for some purpose other than intended, whereby none are available when the need arises.

Accordingly, there is need for a simple and effective bag for storing small objects, particularly in a vehicle, and that is easy to keep track of and that can insure that a warning flag and/or tie down is readily available when needed.

SUMMARY OF THE INVENTION

It is therefore an object of the present invention to provide a simple and economical means that facilitates the storage, retrieval and use of small items, especially on a vehicle such as a boat or in a truck or the like.

Another object of the invention to provide a simple and economical means that facilitates the storage, retrieval and use of small items, and which may also function as a warning flag.

A more particular object of the invention is to provide a warning flag for attachment to objects to call attention to them, and which also serves as a combined storage bag for tie downs, such as bungee cords, and the like.

A further object of the invention is to provide a bag that is shaped, sized and colored so as to be readily visible when used as a warning flag, and which also functions as a storage bag, especially to store a plurality of tie down straps, such as bungee cords and the like.

Another object is to provide a combined warning flag and bag as aforesaid, in which the flag has means for attachment of one of the tie downs, which may then be used as a handle, and/or to secure the flag to an object such as the protruding end of a long load or the like.

In a preferred form of the invention, the bag is made of a material suitable for use in a marine environment, and is especially suited for use on boats to store small items, such as marine quality stretch cords, for example, in a convenient but out-of-the-way location. In this form of the invention, the bag is made of an open mesh PVC material that is resistant to the effects of water and ultraviolet radiation. The open weave of the material forming the bag quickly dries and prevents the accumulation of water in the bag. A rigid header extends across the top of the bag to hold its shape and to serve as a convenient means of securing the bag to the boat and/or to attach a handle. This bar is also preferably made of a material suitable for use in a marine environment, such as ABS plastic.

BRIEF DESCRIPTION OF THE DRAWINGS

The foregoing objects and advantages of the invention, as well as other objects and advantages, will become apparent from the following detailed description when considered in conjunction with the accompanying drawings, in which like reference characters designate like parts throughout the several views, and wherein.

DETAILED DESCRIPTION OF THE PREFERRED EMBODIMENTS

Figure 1:
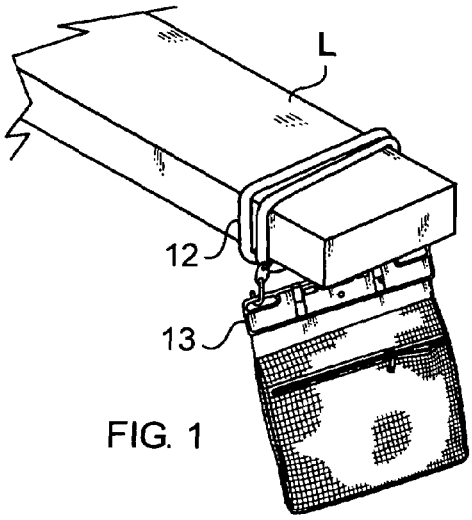
FIG. 1 is a fragmentary perspective view of the bag of the invention, shown being used as a warning flag on a long load.
Figure 2:
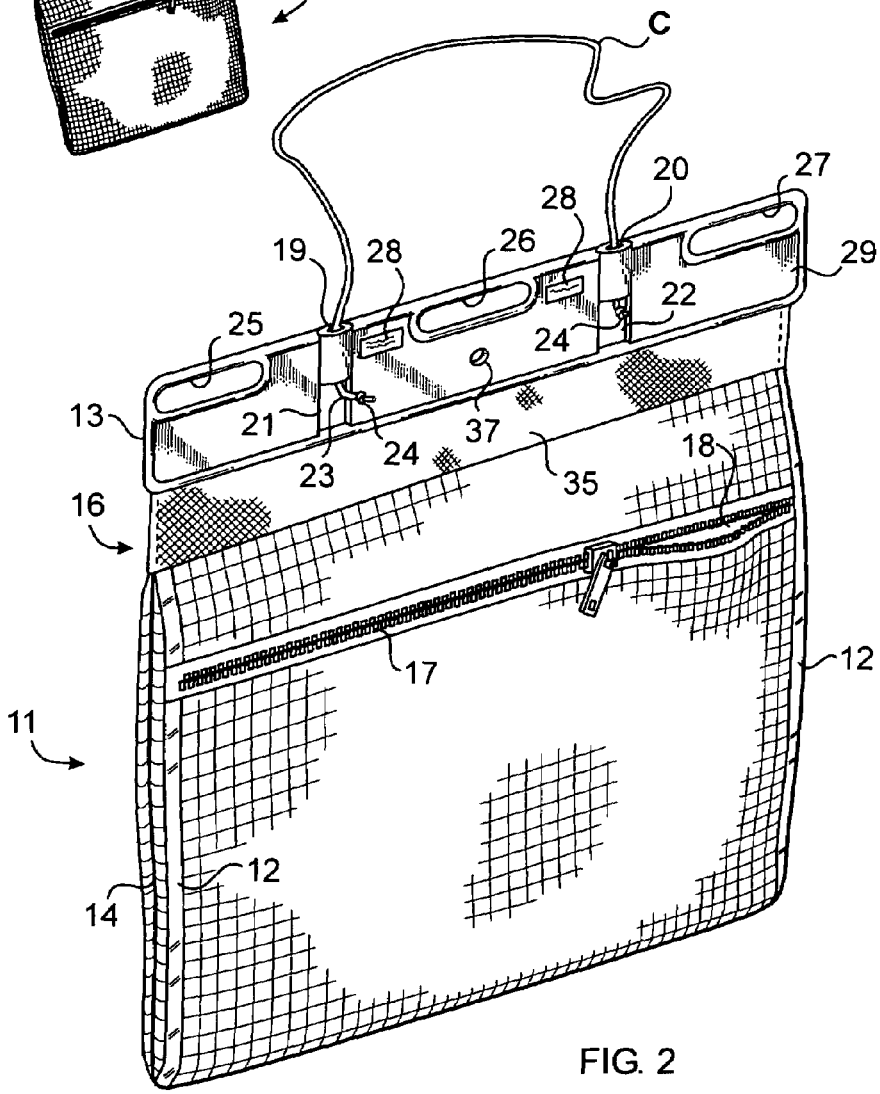
FIG. 2 is a perspective view of the preferred form of the invention.
Figure 3:
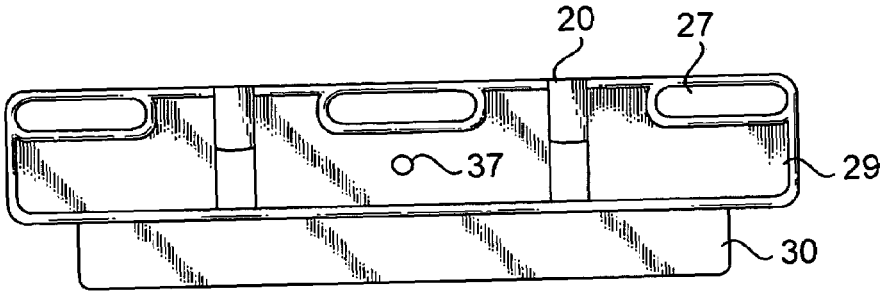
FIG. 3 is a front view in elevation of the header bar used in the preferred form of the invention.
Figure 4:
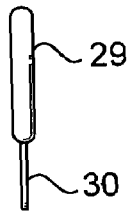
FIG. 4 is an end view in elevation of the header bar.

Referring more particularly to the drawings, a first form of the invention is indicated generally in FIGS. 1–5. As shown in FIG. 1, the storage bag 11 is generally rectangularly shaped and is applied to the end of a load L to serve as a warning flag. The combined flag and storage bag has a size to render it readily visible, and preferably also has a highly visible color. A tie strap 12 may be secured to the flag for attaching it to the protruding end of the load L carried on a vehicle (not shown), and the rectangular, unfurled shape of the flag as seen in this figure is maintained by a rigid header bar 13 extending across the top of the bag.

The bag has a hollow interior for storage of small items, such as tie downs or bungee cords for use as needed.

With particular reference to FIGS. 2–5, the combined flag and bag 11 may be made of a heavy duty, weather-resistant material such as nylon or the like, preferably coated on its inner surface with a water repellant material 15.

The material is folded upon itself, with the water repellant lining on the inside, and secured together at the free ends to a header bar 13. (See FIG. 5). The elongate header bar 13 is positioned to retain the unfurled shape of the flag and bag as depicted in the drawings, and to serve as a means of attachment of a tie strap to secure the flag to a load and/or to serve as a carrying handle.

Strips of reflective material 12 are stitched along opposite side edges of the folded material, together with side panels 14. The reflective material renders the flag more visible at night, and the side panels provide depth to the bag to facilitate storage of additional tie down cords therein.

A zipper 17 is provided in one side of the bag, near the top end 16, to provide an access opening 18 for placing small items, such as cords and the like in the bag, and retrieving them therefrom.

The rigid header bar 13 in this form of the invention comprises an elongate member made of a suitable material, such as ABS plastic, for example, to render it resistant to the effects of water and ultraviolet radiation.

A pair of enlarged, generally cylindrically-shaped openings 19 and 20 are formed through the top edge of the bar, with clearance cut-outs 21 and 22 formed through the bar at the inner or lower ends of the hook-receiving openings. The ends 23 of a cord C may be inserted downwardly through the openings and knots or other enlargements 24 provided on the free ends within the cut-outs to retain the ends in place (see FIG. 2), forming a handle. This handle may be used as a convenient means to carry the bag, and/or to support it from a hook or the like in a boat, for example.

A separate cord or cords may be wrapped around the load and hooked in the hook-receiving openings 25, 26 and 27 formed at spaced locations along the bar to tie the bag to the end of a load to serve as a warning flag.

Suitable indicia 28, such as a company logo, or the like may be placed on the header bar, if desired.

Rather than zipper 17, strips of Velcro® or the like (not shown) may be provided to close the access opening 18.

Figure 5:
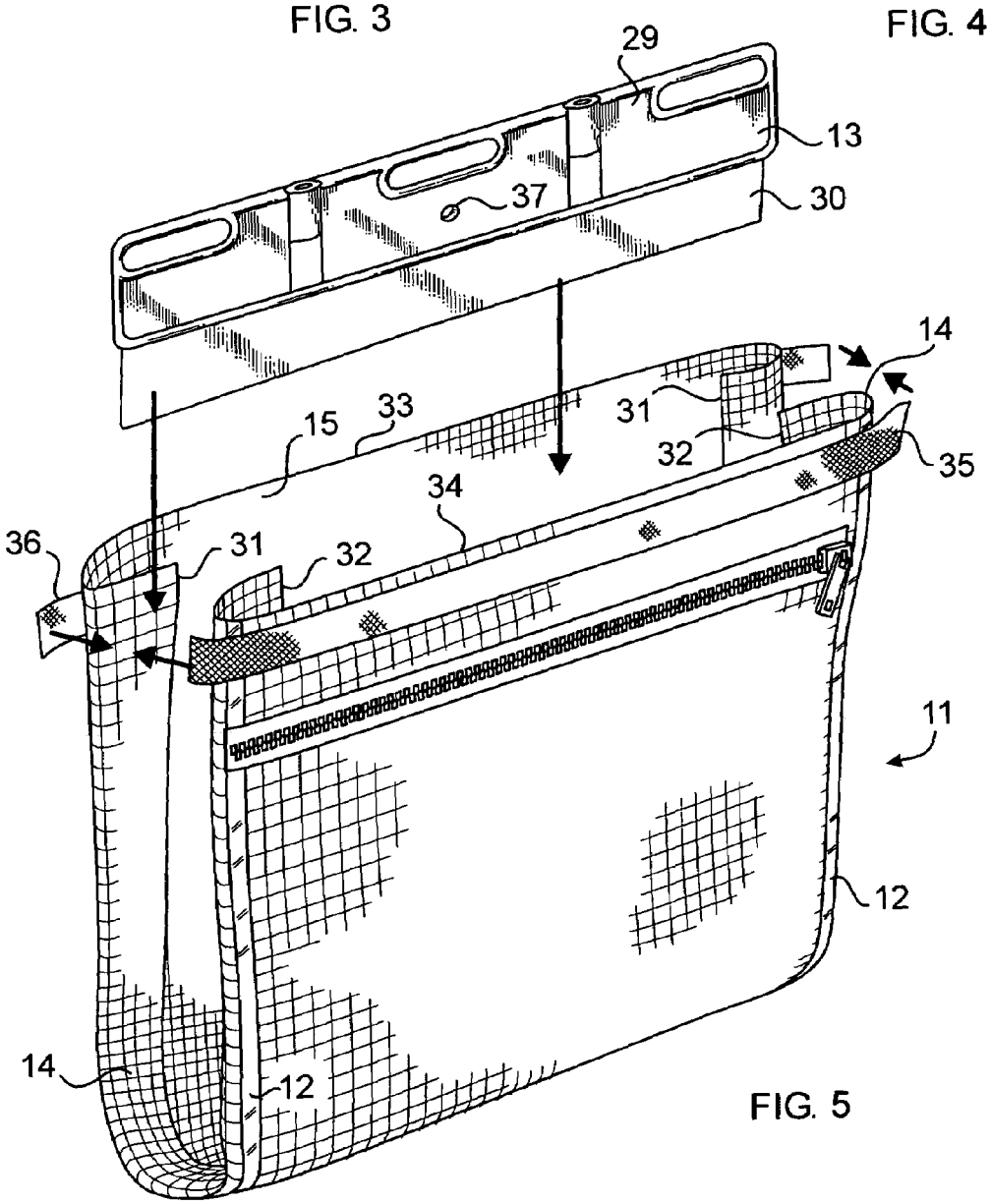
FIG. 5 is an exploded perspective view of the bag and header bar showing how the header bar and bag are assembled.

The header bar 13 comprises a one-piece member having an upper body portion 29 with the plurality of elongate openings 25, 26 and 27 formed transversely therethrough near the upper edge thereof, and the pair of generally cylindrically shaped openings. 19 and 20 formed through the upper edge. A relatively thin, rectangularly shaped fin or flange 30 depends from the upper portion, and as depicted in FIG. 5, is secured between the upper ends of the bag by adhesive and/or stitching or other suitable means.

The bag is made of an open mesh PVC material, and is constructed by folding a rectangular sheet of the material so that the opposite side edges 31 and 32 are turned inwardly and stitched together, or fused together with heat, or otherwise suitably connected, and the free ends 33 and 34 of the material are then placed on opposite sides of the flange 30 and glued and/or stitched to the flange to secure the bag to the header bar. A reinforcing band of material 35 and 36 may be placed on the respective opposite sides of the upper end of the bag to reinforce the attachment to the header bar. When assembled, the stitched seams at the sides of the bag are not visible, thereby enhancing the appearance of the bag.

The open weave PVC material from which the bag is made renders it resistant to the effects of water and ultraviolet radiation, making it particularly suitable for use in a marine environment. Moreover, the open weave of the bag enables it to dry quickly, and it does not retain water when wet objects are placed in it.

An opening 37 may be formed through the main body portion 29 of the header bar for receipt of a nail or other fastener to secure the bag to a support surface.

Although this invention has been illustrated and described in detail herein, it is to be understood that various modifications and variations may be made in the construction without departing from the spirit and scope of the invention, as defined in the appended claims.

What is claimed is:

1. A combined warning flag and storage bag, comprising:

a bag having a hollow interior and an access opening;

a rigid member extending along a top edge of the bag; and means for securing the bag to an object;

wherein said bag comprises a body of open mesh material stitched along opposite side edges to form said hollow interior, said body having free ends secured to said rigid member on opposite sides thereof, wherein the rigid member further comprises a generally rectangularly shaped body portion, and a relatively thin, depending flange having opposite sides; and said flange is placed between the free ends of the bag, and each of said free ends is secured to one of said sides.

2. A combined warning flag and storage bag as claimed in claim 1, wherein:

the rectangularly shaped body portion of the rigid member has a plurality of openings extended transversely therethrough for receiving tie-down straps or other fasteners; and at least one opening formed through an upper edge thereof for receiving an end of a strap to function as an angle or as a tie-down means.

3. A combined warning flag and storage bag as claimed in claim 1, wherein:

a reflective strip is applied to said bag to render it more visible at night time.

4. A combined warning flag and storage bag as claimed in claim 1, wherein:

the material comprises a water-repellant coating.

5. A combined warning flag and storage bag as claimed in claim 1, wherein:

the body portion has indicia-receiving means thereon.

6. A storage bag for storing small items, comprising:

a hollow body formed of open weave mesh material, said body having front and back sides, a closed bottom, an a closed top;

an elongated rigid header bar secured to the closed top and retaining the shape of the bag in unfolded condition, said header bar serving as a means for attaching the bag to a support, and for attaching a handle to the bag;

a closable opening formed through the front side of the bag near closed top, through which items may be placed in the bag and retrieved therefrom; and said open weave mesh material comprising PVC plastic, thereby rendering the bag resistant to the effects of water and ultraviolet radiation and enabling the bag to dry quickly and preventing collection of water therein, whereby the bag is specially suitable for marine use;

wherein:

the header bar has hook-receiving openings formed therethrough for receiving fasteners to secure the bag to a support; and said header bar has a generally flat, rectangular upper body portion, and a relatively thin, depending flange, said flange having opposite sides being secured to the close top of the bag.

7. A combined warning flag and storage bag as claimed in claim 6, wherein:

a reflective strip is applied to said bag to render it more visible at night time.

8. A combined warning flag and storage bag as claimed in claim 6, wherein:

the header bar has indicia-receiving means thereon.

* * * * *